US005749527A

United States Patent [19]

Fujikawa et al.

[11] Patent Number: 5,749,527

[45] Date of Patent: May 12, 1998

[54] SOLENOID FUEL INJECTION VALVE

[75] Inventors: Takuya Fujikawa; Katsuhiko Abe, both of Saitama, Japan

[73] Assignee: Zexel Corporation, Tokyo, Japan

[21] Appl. No.: 594,272

[22] Filed: Jan. 30, 1996

[30] Foreign Application Priority Data

Feb. 3, 1995 [JP] Japan ..... 7-037739

[51] Int. Cl.[6] ..... B05B 1/30; F16K 31/02

[52] U.S. Cl. ..... 239/585.3; 251/129.16; 251/129.21

[58] Field of Search ..... 239/585.1, 585.3, 239/585.5; 251/129.16, 129.21

[56] References Cited

U.S. PATENT DOCUMENTS

| | | | |
|---|---|---|---|
| 1,284,021 | 11/1918 | Wright | 251/129.21 |
| 1,999,221 | 4/1935 | Walker et al. | 239/585.3 X |
| 5,035,360 | 7/1991 | Green et al. | 239/585.3 |
| 5,046,472 | 9/1991 | Linder | 239/585.3 X |
| 5,192,048 | 3/1993 | Wakeman | 239/585.5 X |
| 5,244,180 | 9/1993 | Wakeman et al. | 239/585.5 X |
| 5,494,224 | 2/1996 | Hall et al. | 239/585.5 |

FOREIGN PATENT DOCUMENTS 1-104960 4/1989 Japan .

*Primary Examiner*—Andres Kashnikow
*Assistant Examiner*—Robin O. Evans
*Attorney, Agent, or Firm*—Ostrolenk, Faber, Gerb & Soffen, LLP

[57] ABSTRACT

A solenoid fuel injection valve includes a face-type armature 32 having a coupling section 37 coupled with the needle valve 10 and a flat section 36. The armature 32 is accommodated in an armature chamber 38 and the flat section 36 partitions the armature chamber 38 into an upper armature chamber 39 and a lower armature chamber 40. A fuel passage (peripheral fuel passage 41) for communicating the upper armature chamber 39 and the lower armature chamber 40 is provided at a location other than the flat section 36 of the armature 32. The provision of the peripheral fuel passage 41 in this manner prevents bouncing of the needle valve 10 during valve opening, suppresses secondary injection, reduces noise especially during valve opening, and stabilizes the operation of the needle valve 10 during valve closing.

13 Claims, 11 Drawing Sheets

FIG.2
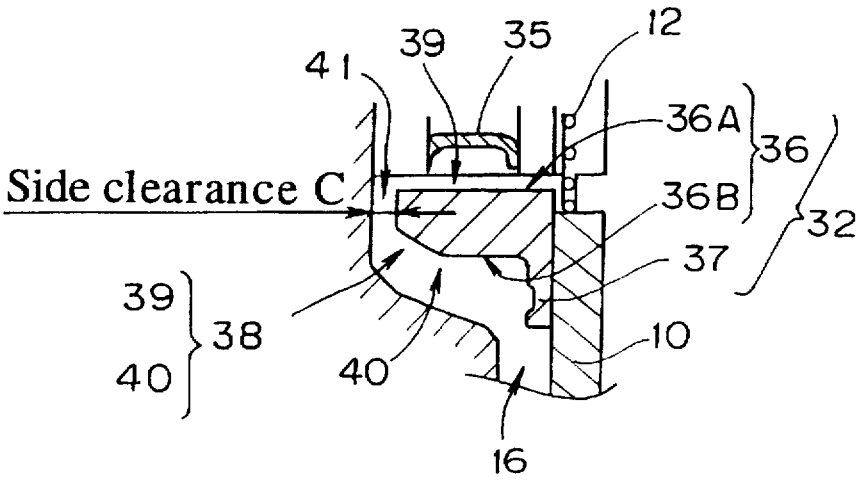
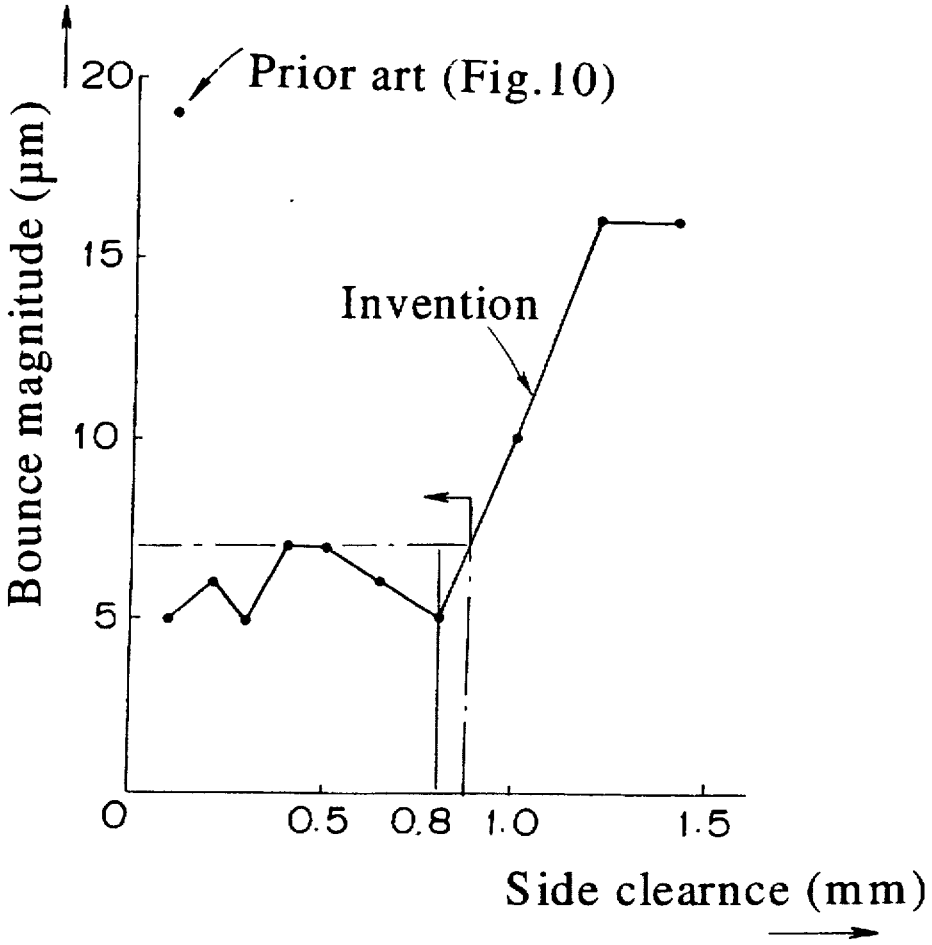

FIG. 8 PRIOR ART

Table 1

| | Injection into intake manifold | Injection into cylinder |
|---|---|---|
| Injection place | Intake manifold | Cylinder |
| Fuel pressure | 0.2 ~ 0.3 MPa | 4 ~ 10 MPa |
| Backpressure | -0.05 ~ +0.05 MPa | -0.05 ~ 10 MPa |
| Backpressure medim | Air | Air and combustion gas |
| Period injection possible | All strokes | Intake to compression stroke |
| Fuel | Gasoline | Gasoline |

FIG. 9 PRIOR ART

Table 2

| | Injection into intake manifold | Injection into cylinder |
|---|---|---|
| Fsp (min) | 0.4 kgf | 4.9 kgf |
| Fp | 0.06 kgf | 4.9 kgf |
| Total | 0.46 kgf | 9.8 kgf |

SOLENOID FUEL INJECTION VALVE

BACKGROUND OF THE INVENTION

1. Field of the Invention

This invention relates to a solenoid fuel injection valve, more particularly to a solenoid fuel injection valve for preventing secondary injection of fuel in a direct fuel injection system or the like.

2. Prior Art

Among the prior-art solenoid fuel injection valves, the so-called low-pressure solenoid fuel injection valve is mounted, for example, on the intake manifold of an internal combustion engine and used to inject gasoline or other such fuel into the intake manifold. A description of such a solenoid fuel injection valve can be found, for instance, in Japanese Patent Public Disclosure Hei 1-104960. A general explanation of this solenoid fuel injection valve will be given with reference to FIG. 7.

FIG. 7 is a vertical sectional view of a prior-art solenoid fuel injection valve 1 having a connector 2, a valve housing 3, nozzle cover 4, a fuel supply pipe 5 made of a magnetic material, a spring seat 6, a valve seat 7, and a solenoid winding 8 which is energized/deenergized by a control signal received through the connector 2.

A cylinder-shaped armature 9 and a needle valve 10 integrally movable with the armature 9 are provided to face the fuel supply pipe 5 from below as seen in the drawing.

A nozzle 11 is formed in the tip of the valve seat 7 and the needle valve 10 is constantly biased toward a nozzle 11 by a valve spring 12 so as to be seated on a seat portion 7A of the valve seat 7.

Gasoline or other such fuel is supplied through a fuel supply port 13 at the top (as seen in the drawing) of the fuel supply pipe 5 to a first fuel passage 14, from the first fuel passage 14 to a second fuel passage 15 inside the armature 9 and then to a third fuel passage 16 between the valve seat 7 and the needle valve 10.

When the solenoid actuator 8 is energized, the armature 9 and needle valve 10 are lifted by an amount of lift L (the lift of the needle valve 10; defined by the interval between a stepped portion of the needle valve 10 and a valve stop 17) and fuel is injected from the nozzle 11 into an engine intake manifold 18.

When the solenoid winding 8 is deenergized, the armature 9 and the needle valve 10 are restored to their original positions by the force of the valve spring 12, thereby closing the nozzle 11.

The solenoid fuel injection valve 1 of this configuration is referred to as a plunger-type solenoid fuel injection valve. When the plunger-type solenoid fuel injection valve 1 is used to inject fuel not into the intake manifold 18 but directly into an engine cylinder, i.e., when it is used as a high-pressure solenoid fuel injection valve for so-called direct fuel injection, the fuel pressure is increased for supplying more finely atomized fuel directly into the cylinder for combustion.

Owing to the increased fuel pressure obtained with the direct injection type solenoid fuel injection valve, it is possible to achieve cleaner exhaust and improved fuel economy. The differences between this type of solenoid fuel injection valve and the aforesaid solenoid fuel injection valve 1 for injecting fuel into the intake manifold 18 are summarized in Table 1 of FIG. 8.

In Table 1 of FIG. 8, "backpressure" is the pressure that a seat-diameter portion 10A (seat diameter S) of the needle valve 10 receives from the exterior of the solenoid fuel injection valve (the interior of the intake manifold 18 or the cylinder combustion chamber) and represents the force with which air and/or combusted gas attempts to invade the interior of the solenoid fuel injection valve. A backpressure of zero is atmospheric pressure.

A direct injection type solenoid fuel injection valve operating in the environment indicated in Table 1 of FIG. 8 requires properties not possessed by the solenoid fuel injection valve 1 for injecting fuel into the intake manifold 18.

This will be explained more specifically. The external forces acting on the needle valve 10 are the load (Fsp) applied by the valve spring 12 for dynamically adjusting the quantity of fuel injection and the fuel pressure (Fp).

As Fsp there is required a load sufficient to prevent opening of the closed needle valve 10 by the backpressure.

Fp is present when the needle valve 10 is closed and is equal to (seat area of needle valve 10)×(fuel pressure per unit area).

Table 2 of FIG. 9 shows the pressure acting on the needle valve 10 when fuel is injected into the intake manifold 18 and when fuel is injected into a cylinder. The data shown are based on a seat diameter of 2.5 mm and a fuel pressure of 100 $Kg/cm^2$.

As shown in Table 2 of FIG. 9, the minimum force of the solenoid winding 8 required for attracting the armature 9 when fuel is injected into the intake manifold 18 is (0.46 Kgf+force for driving needle valve 10), whereas it reaches (9.8 Kgf+force for driving needle valve 10) in the case of a direct fuel injection system.

The maximum force of the solenoid winding 8 of a solenoid fuel injection valve for injecting fuel into an intake manifold 18 is about 2 Kgf.

It is therefore impossible to use a solenoid fuel injection valve 1 designed for injection into an intake manifold 18 in a direct fuel injection system unless it is structurally modified for use in a high-pressure operating environment. The structural modifications required include: (1) an increase in the attractive force of the solenoid winding 8, (2) reduction of the seat diameter for decreasing the effect of fuel pressure and backpressure, and (3) an increase in rigidity.

U.S. Pat. No. 5,244,180 teaches a valve of a different type from the plunger type solenoid fuel injection valve 1 shown in FIG. 7, namely the face-type solenoid fuel injection valve 20 shown in FIG. 10. In the following explanation of the solenoid fuel injection valve 20, components corresponding to those in FIG. 7 will be assigned the same reference symbols as those in FIG. 7 and will not be explained again.

FIG. 10 is a vertical sectional view of the solenoid fuel injection valve 20. Unlike the solenoid fuel injection valve 1, which has a plunger type armature 9, the solenoid fuel injection valve 20 adopts a flat or so-called face-type armature 21.

The armature 21 is accommodated in an armature chamber 22 which communicates with the fuel supply port 13.

Since for the same amount of space this configuration of the solenoid fuel injection valve 20 enables an enlargement of the attraction area of the armature 21 over that attainable in the solenoid fuel injection valve 1, it is capable of producing a greater attractive force.

Like the solenoid fuel injection valve 1, most solenoid fuel injection valves which do not require such strong attractive force use plunger type armatures like the armature 9.

The direct fuel injection system is applied to engines of the same size as earlier systems and since the solenoid fuel injection valve 20 therefore has to be located very close to the cylinder, it has to be installed at a place where it does not interfere with the exhaust valve and spark plug. Therefore, the practice is to give the solenoid fuel injection valve 20 a thinner diameter than the solenoid fuel injection valve 1 throughout and to enhance the operating durability of the needle valve 10 and its response to the control pulses which drive it by providing the armature 21 with multiple axial direction holes 23 that reduce its weight, while simultaneously securing sufficient area for the passage of the required magnetic flux.

However, adoption of this face-type armature 21 leads to the following problem.

The operation of the needle valve 10 produces fuel pressure fluctuations in the solenoid fuel injection valve 20, particularly in the armature chamber 22, and these fuel pressure fluctuations in turn induce bouncing of the needle valve 10 after it has seated. As a result, a large quantity of secondary injection occurs.

This will be better understood from the graph of FIG. 11, which shows the pressures received by the top and bottom pressure receiving surfaces of the armature 21. Just after seating of the needle valve 10, the pressure on the bottom of the armature 21 is greater than that on the top thereof. Since the difference between the two pressures operates as a force tending to lift the needle valve 10 in the opening direction, it contributes to bouncing of the needle valve 10 and increases the quantity of secondary injection.

Since the quantity of fuel injected during the secondary injection cannot be controlled and the fuel is injected in coarse droplets, the increased quantity of secondary injection aggravates hydrocarbon and smoke emissions.

Further, as can be seen from the graph of FIG. 12 showing the time-course change in sound pressure during injection, noise is produced during opening of the needle valve 10 and is also produced as a mixture of different frequencies during valve closing. In other words, a noise problem arises during engine operation.

This invention was accomplished in light of the foregoing problems. One of its objects to provide a solenoid fuel injection valve employing a face-type armature, wherein bouncing of the needle valve is prevented to suppress secondary injection.

Another object of the invention is to provide a solenoid fuel injection valve whose fuel passage is designed for suppressing bouncing of the needle valve when it is seated.

Another object of the invention is to provide a solenoid fuel injection valve which reduces noise produced by the needle valve particularly during valve opening.

Another object of the invention is to provide a solenoid fuel injection valve which enables stable operation during needle valve closing, particularly in an injector used in a direct fuel injection system.

SUMMARY OF THE INVENTION

The invention achieves the foregoing objects by improving the location at which the fuel passage is formed in the armature portion. More specifically, the invention provides a solenoid fuel injection valve having a valve housing, a solenoid winding provided in the valve housing, an armature responsive to energizing of the solenoid winding, a valve seat formed with a nozzle communicable with a fuel supply port through a fuel passage, and a needle valve enabling fuel to be injected from the nozzle into a cylinder of an engine when it is raised together with the armature in response to energizing of the solenoid winding to be lifted off a seat portion of the valve seat, the armature being constituted of a coupling section coupled with the needle valve and a flat section integral with the coupling section, the flat section partitioning an armature chamber accommodating the armature into an upper armature chamber and a lower armature chamber, and a portion of the fuel passage communicating the upper armature chamber and the lower armature chamber being provided at a location other than the flat section of the armature.

The armature chamber can be utilized as a fuel reservoir at an intermediate portion of the fuel passage between the fuel supply port and the nozzle.

The interior of the coupling section can be formed with an axial fuel passage communicating the fuel supply port and the nozzle and the axial fuel passage be disposed to face into the armature chamber.

The portion of the fuel passage communicating the upper armature chamber and the lower armature chamber can be provided outward from the flat section.

The solenoid fuel injection valve according to this invention utilizes an armature which, differently from conventional armatures, does not have through-holes connecting its top and bottom surfaces located between its outer peripheral surface and inner axial region but is formed with a fuel passage at a location outward of its outer peripheral surface and/or at its inner axial region. As a result, the pressures received by the armature from the surrounding fuel during valve opening and closing act on the flat section of the armature and control its operating speed.

More specifically, rapid rise in fuel pressure in the space above the upper surface of the armature (upper armature chamber) is suppressed, particularly during valve opening, so that little noise is produced owing to collision between the armature and the valve housing.

In addition, the collision speed between the needle valve and the valve seat is reduced by the fuel pressure in the lower armature chamber, particularly during valve closing, so that bouncing of the needle valve is prevented and secondary injection suppressed.

The fuel injection operation can therefore be included in the range of controllable factors, enabling optimization of fuel droplet diameter and suppression of hydrocarbon and smoke generation.

In other words, the provision of the fuel passage at a portion other than the pressure receiving surfaces of the armature, where it has conventionally been provided, greatly reduces sudden armature movement (rise and fall) owing to pressure fluctuation in the armature chamber with armature operation and, as a result, enables stabilization of needle valve operation.

By appropriate selection of the sectional area of the fuel passage, moreover, it is possible to achieve desired levels of high armature response, operating durability and weight reduction.

BRIEF DESCRIPTION OF THE DRAWINGS

FIG. 2 is an enlarged view of the section defining a peripheral fuel passage 41 in the solenoid fuel injection valve 30 and a graph showing how the bounce magnitude of a needle valve 10 varies with the side clearance C of the peripheral fuel passage 41.

FIG. 4 is a graph showing how the lift L of the needle valve 10 varies with time after a pulse for energizing a solenoid winding 8 is turned ON.

FIG. 8 shows a Table 1 giving particulars of prior solenoid fuel injection valves for injecting fuel into an intake manifold 18 and for injecting fuel into a cylinder.

FIG. 9 shows a Table 2 indicating the pressures acting on a needle valve 10 in the case of injecting fuel into an intake manifold 18 and the case of injecting fuel into a cylinder.

DETAILED DESCRIPTION OF THE PREFERRED EMBODIMENTS

A solenoid fuel injection valve 30 which is an embodiment of this invention will now be explained with reference to FIGS. 1 to 6, in which portions similar to those in FIGS. 7 to 12 are assigned the same reference symbols as those in FIGS. 7 to 12 and will not be explained again.

Figure 1:
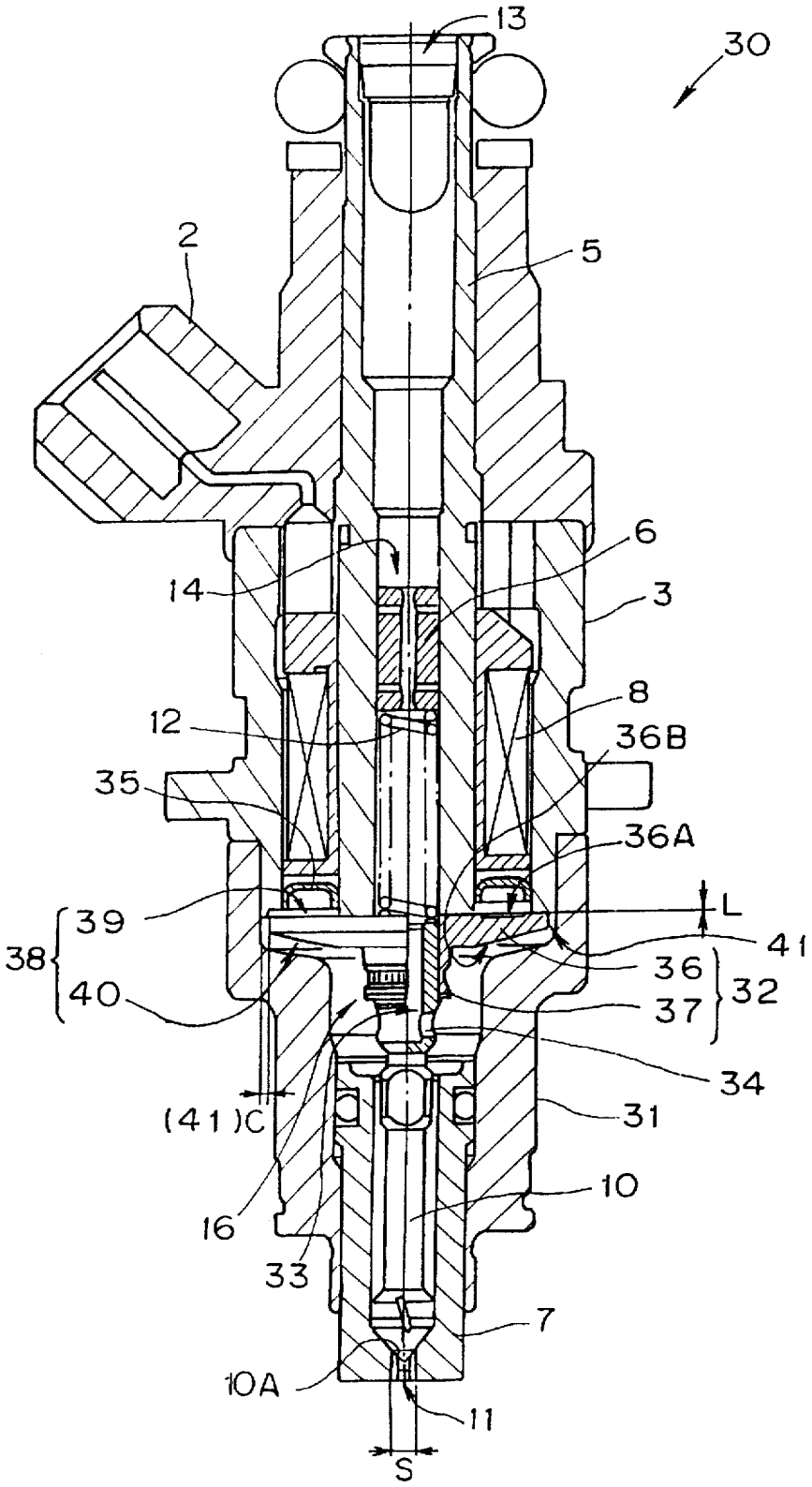
FIG. 1 is a vertical sectional view of a solenoid fuel injection valve 30 which is an embodiment of this invention.

FIG. 1 is a vertical sectional view of the solenoid fuel injection valve 30, which comprises a nozzle holder 31 in place of the nozzle cover 4 mentioned earlier and the valve seat 7 is fixed to the nozzle holder 31.

In addition, the armature 9 of the configuration explained above is replaced by a flat armature 32. The needle valve 10 moves integrally with the armature 32.

The needle valve 10 has an axial fuel passage 33 corresponding to the second fuel passage 15 mentioned earlier and a communicating hole 34 communicating the axial fuel passage 33 with the third fuel passage 16.

The lift L of the needle valve 10 is defined by the interval between the armature 32 and the fuel supply pipe 5.

An anti-invasion cover 35 is provided to prevent invasion of fuel in the direction of the solenoid winding 8.

The flat armature 32 has a flat section 36 and at the axial center portion of the flat section 36 a coupling section 37 laser-welded to the needle valve 10.

The armature 32 is accommodated in an armature chamber 38, which is defined by the nozzle holder 31, the valve housing 3 and the fuel supply pipe 5, and communicates with the third fuel passage 16.

The flat section 36 of the armature 32 partitions the armature chamber 38 into an upper armature chamber 39 opposite the anti-invasion cover 35 and a lower armature chamber 40 adjacent to the third fuel passage 16. The armature chamber 38 and the third fuel passage 16 together constitute a fuel reservoir.

The upper armature chamber 39 and the lower armature chamber 40 are in communication through a peripheral fuel passage 41 formed as a small gap (side clearance C) between the nozzle holder 31 and outer peripheral surface of the flat section 36.

Owing to the aforesaid configuration, the top pressure receiving surface 36A of the flat section 36 faces the anti-invasion cover 35 across the upper armature chamber 39, while the bottom pressure receiving surface 36B thereof faces into the lower armature chamber 40.

Figure 10:
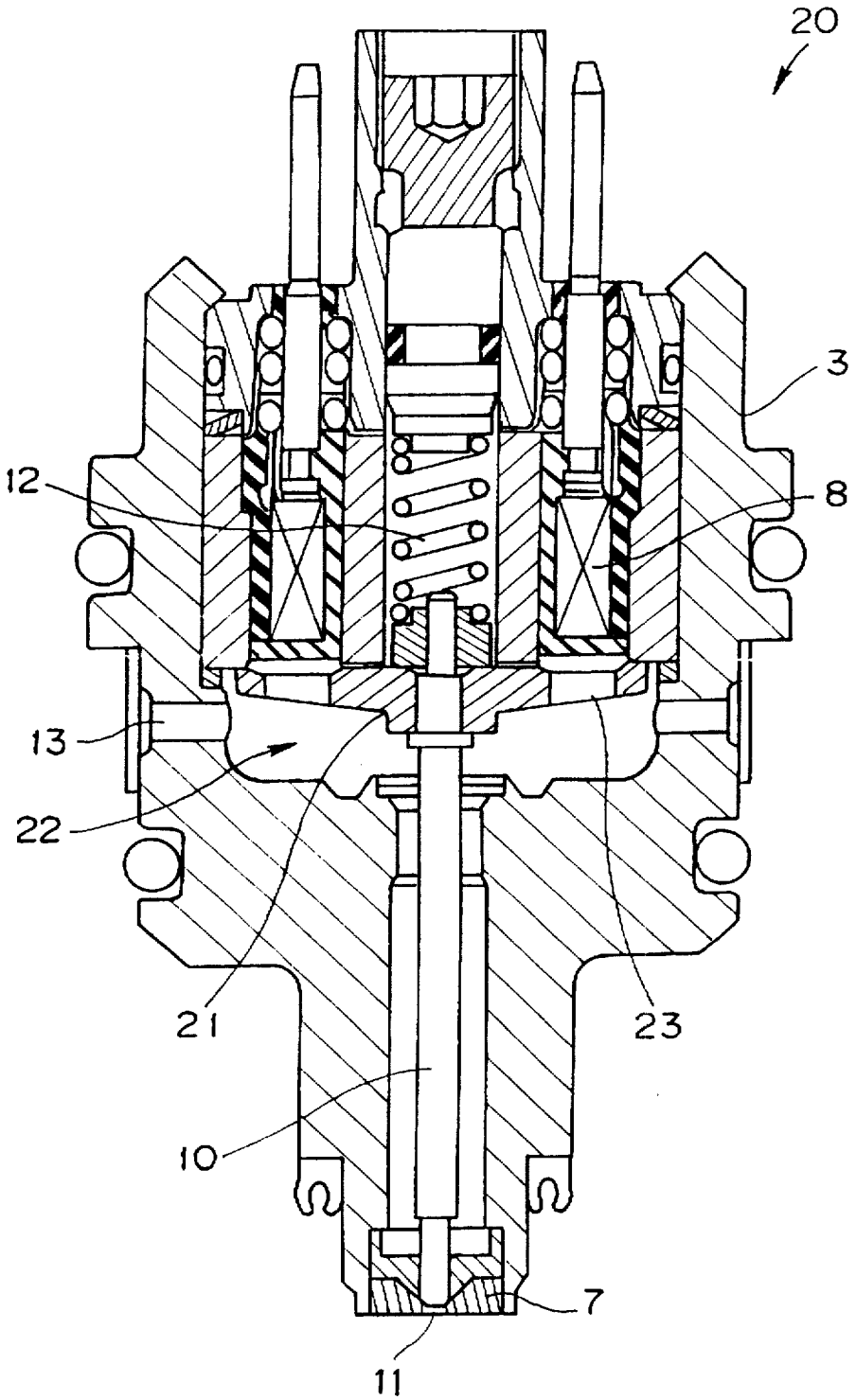
FIG. 10 PRIOR ART
FIG. 10 is a vertical sectional view of a prior-art face-type solenoid fuel injection valve 20.

Since the armature 32 (the flat section 36) is not formed with the holes 23 present in the armature 21 shown in FIG. 10, the whole of the flat section 36 can be used for the pressure receiving surfaces, while the peripheral fuel passage 41 for enabling the flat armature 32 to move vertically (for valve opening and closing) is formed at the periphery of the flat section 36, at a location unrelated to either the top pressure receiving surface 36A or the bottom pressure receiving surface 36B.

In the solenoid fuel injection valve 30 of this configuration, the fuel supply port 13 communicates with the third fuel passage 16 through the first fuel passage 14, the axial fuel passage 33, the communicating hole 34 and the armature chamber 38.

Further, the first fuel passage 14 communicates with the gap defining the lift L (the upper armature chamber 39) defined by the armature 32 below and the valve housing 3 and the fuel supply pipe 5 above, and further through the peripheral fuel passage 41 with the armature chamber 38 and the third fuel passage 16.

When the solenoid winding 8 is energized, therefore, fuel in the upper armature chamber 39 flows into the lower armature chamber 40 through the peripheral fuel passage 41 and the axial fuel passage 33 to enable lifting of the armature 32.

When the solenoid winding 8 is deenergized, fuel in the lower armature chamber 40 flows through the peripheral fuel passage 41 and the axial fuel passage 33 into the upper armature chamber 39 and toward the first fuel passage 14 side to enable lowering of the armature 32.

The graph in FIG. 2 shows how the bounce magnitude of the needle valve 10 varies with the side clearance C of the peripheral fuel passage 41. As this graph shows, the bounce magnitude of the needle valve 10 can be restricted to under a desired upper limit value by selecting the side clearance C (the cross-sectional area of the peripheral fuel passage 41) within a certain range of values. To suppress bouncing of the needle valve 10, the side clearance C is preferably set at 0.1 mm–1.5 mm, more preferably at 0.2 mm–0.9 mm.

The example shown in FIG. 2 is based on results obtained for an armature 32 having a flat section 36 measuring 16.6 mm in diameter.

Figure 3:
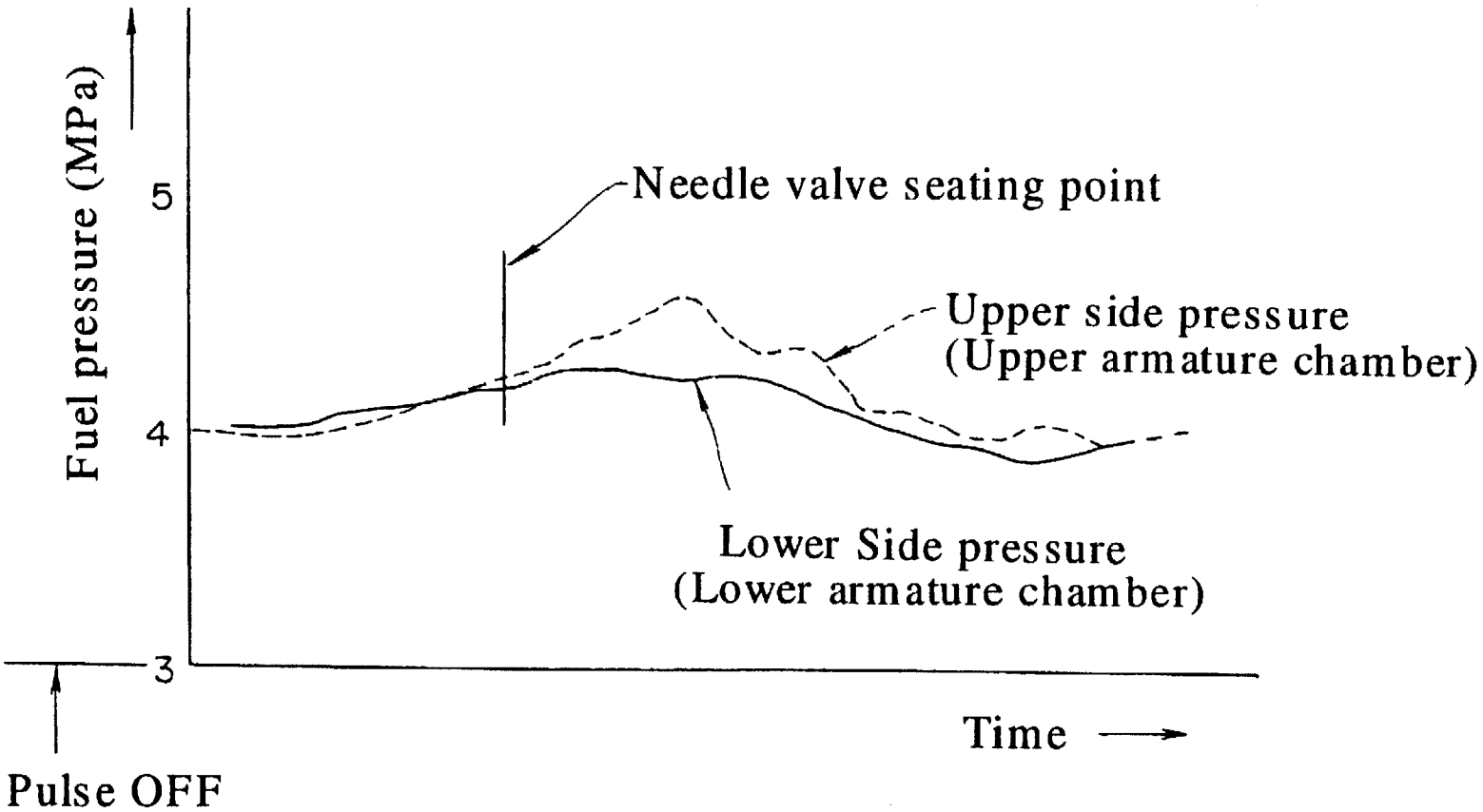
FIG. 3 is a graph showing how the pressures acting on top and bottom pressure receiving surfaces of an armature 21 of the solenoid fuel injection valve 30 vary with time following seating of the needle valve 10.
Figure 11:
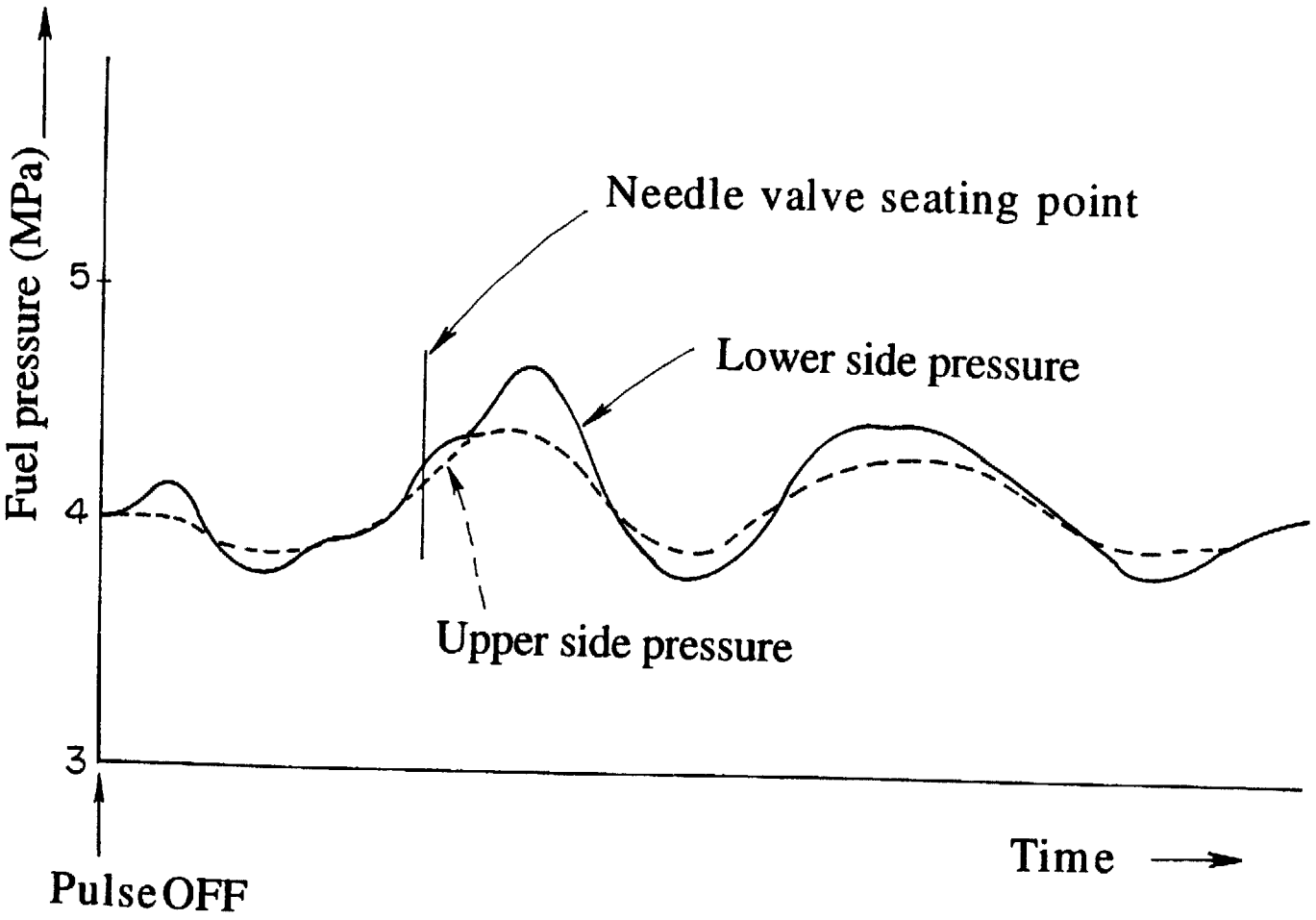
FIG. 11 PRIOR ART
FIG. 11 is a graph showing how the pressures acting on top and bottom pressure receiving surfaces of an armature 21 of the solenoid fuel injection valve 20 vary with time following seating of a needle valve 10.

As shown by the graph of FIG. 3, which is similar to that of FIG. 11, between the pressures acting on the top and bottom surfaces of the flat section 36 after seating of the needle valve 10 in the solenoid fuel injection valve 30, that acting on the top pressure receiving surface 36A (the pressure in the upper armature chamber 39) is greater than that acting on the bottom pressure receiving surface 36B (the pressure in the lower armature chamber 40). Since the difference between the two pressures acts as a force pressing the needle valve 10 in the valve closing direction, the quantity of secondary injection can be reduced.

Figure 4:
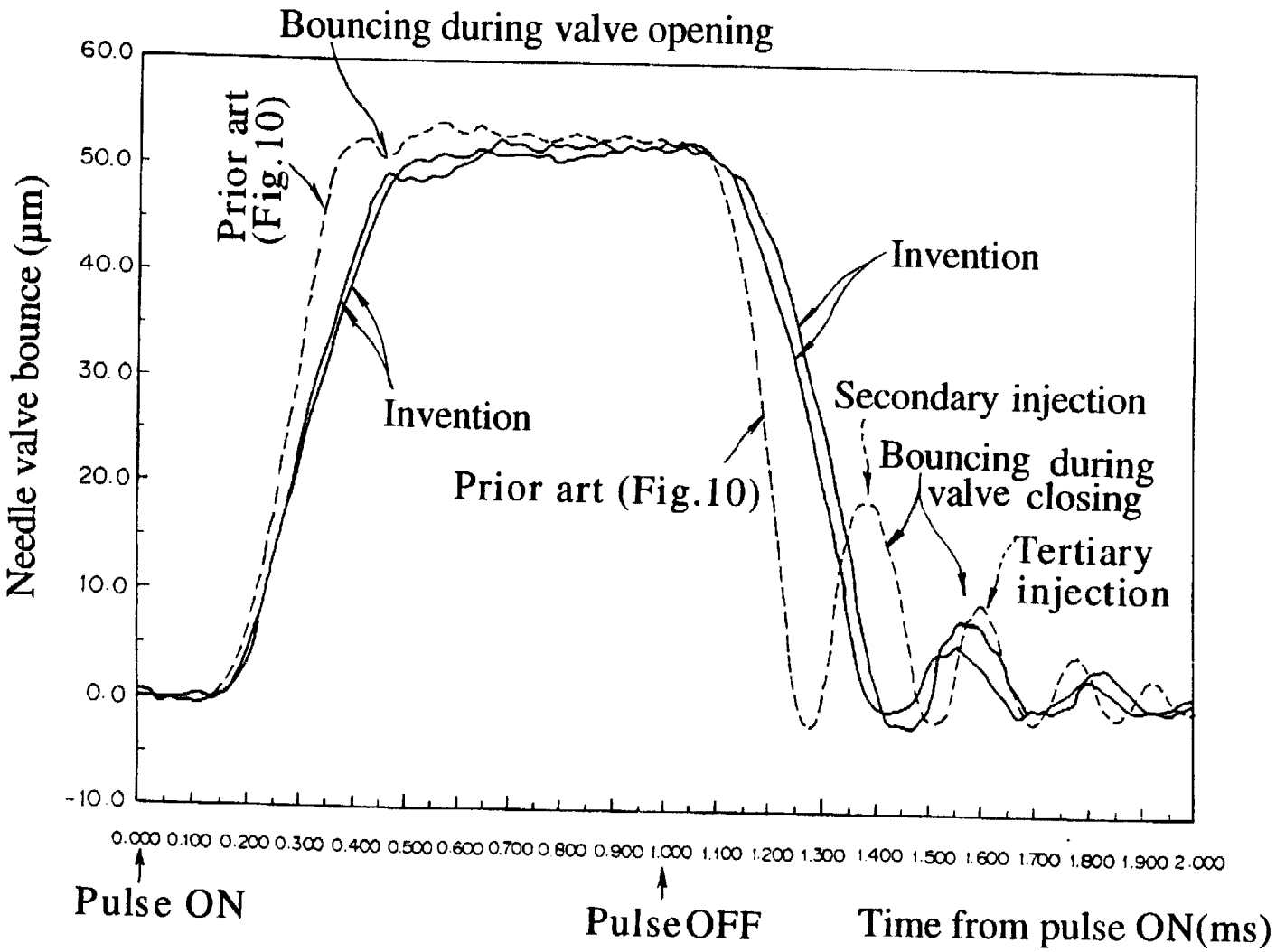

The graph in FIG. 4 shows how the lift L of the needle valve 10 varies with time after a pulse for energizing the solenoid winding 8 is turned ON. It will be noted that the prior-art solenoid fuel injection valve 20 (FIG. 10) experiences both bouncing at the time of valve opening and secondary and tertiary injection at the time of valve closing, whereas solenoid fuel injection valve according to the invention suppresses operational instability and achieves substantial suppression of bouncing during valve opening and closing.

Figure 5:
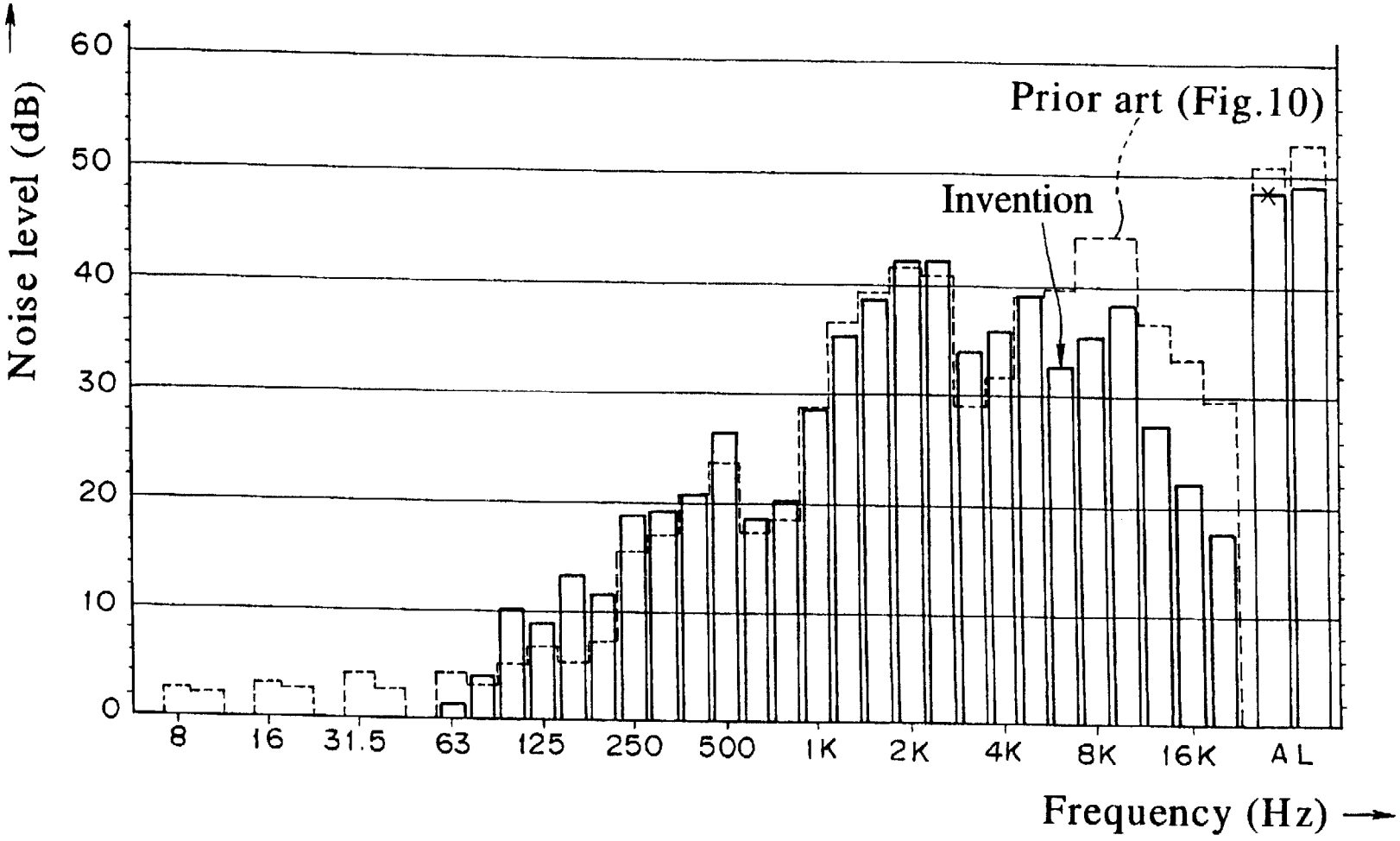
FIG. 5 is a graph showing how mean noise level varies with sound frequency during valve opening in prior-art and invention solenoid fuel injection valves.

The graph of FIG. 5 shows how mean noise level varies with sound frequency during valve opening. It will be noted that the noise produced by the solenoid fuel injection valve 30 (solid lines) is lower than that of the solenoid fuel injection valve 20 etc. (dashed lines), particularly in the tinny noise region in the vicinity of 8 kHz.

Figure 6:
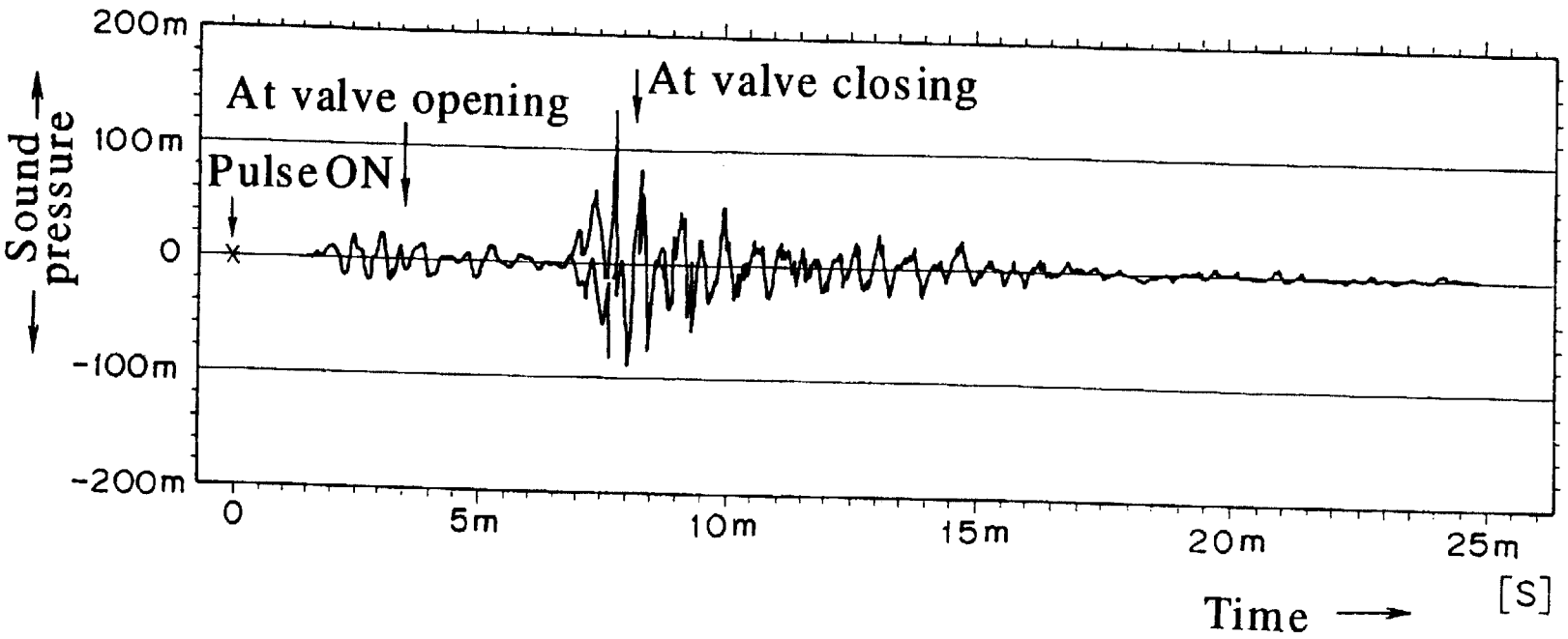
FIG. 6 is a graph showing how sound pressure varies with time during injection in the solenoid fuel injection valve 30.
Figure 7:
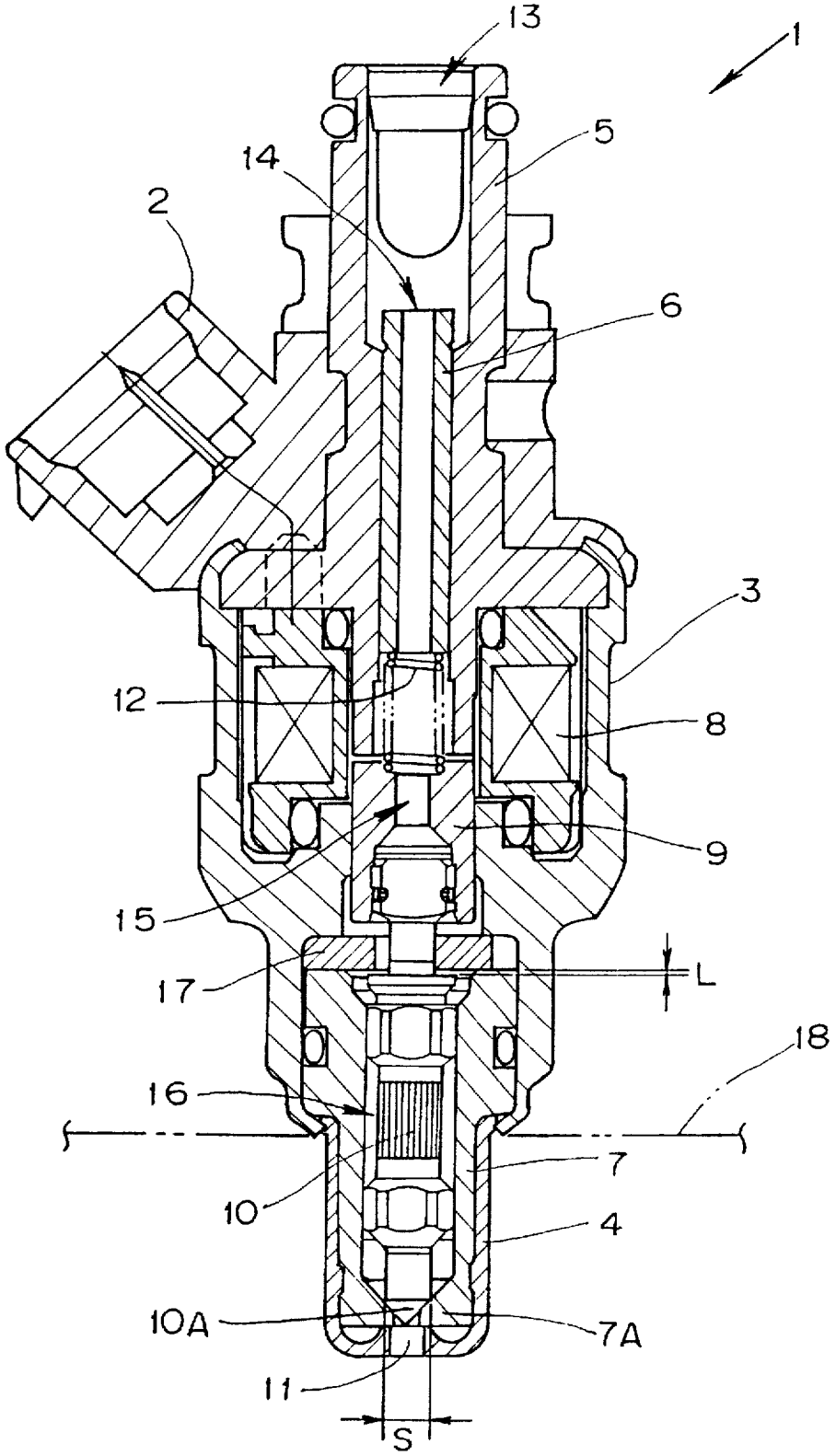
FIG. 7 PRIOR ART
FIG. 7 is a vertical sectional view of a prior-art low-pressure solenoid fuel injection valve 1 of the plunger type.
Figure 12:
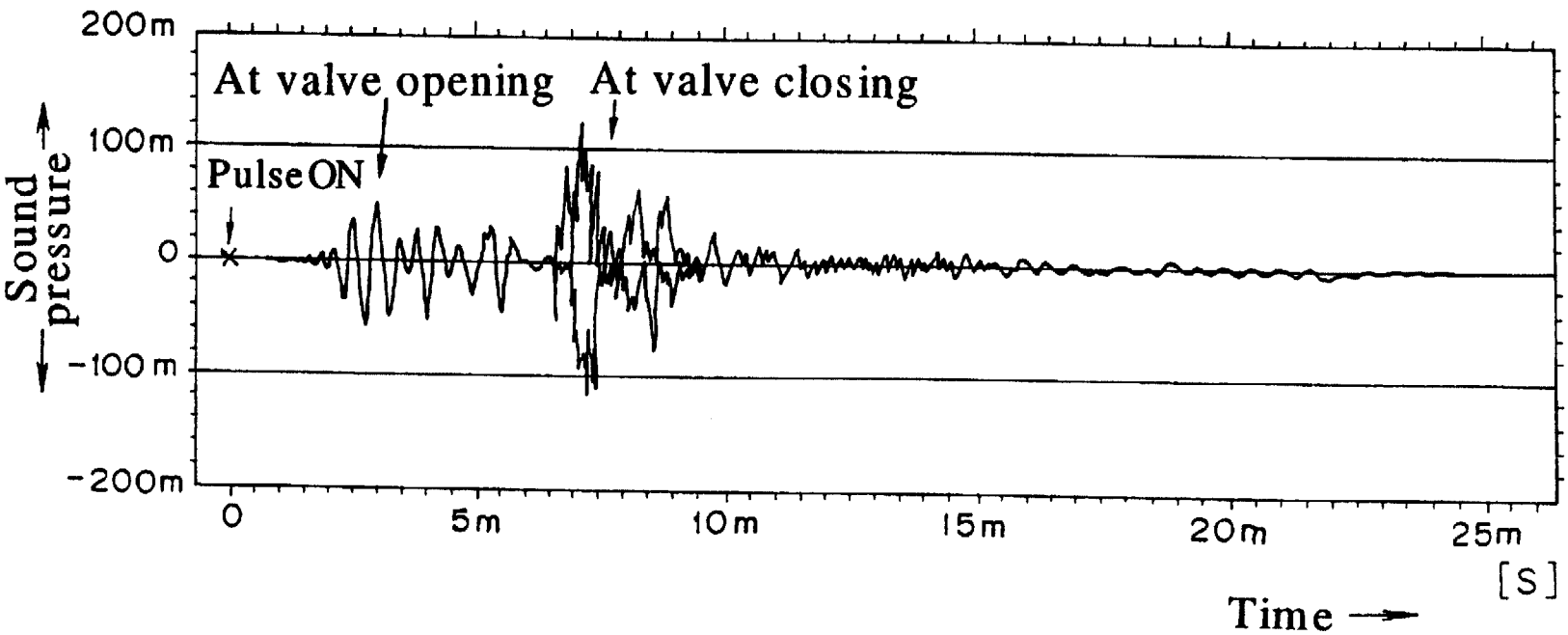
FIG. 12 PRIOR ART
FIG. 12 is a graph showing how sound pressure varies with time during valve opening in the solenoid fuel injection valve 20.

The graph of FIG. 6, which is similar to that of FIG. 12, shows how sound pressure varies with time during injection in the solenoid fuel injection valve 30. It will be noted that noise is suppressed during valve opening and that the number of mixed frequencies during valve closing is smaller.

In this invention, the vertical movement of the needle valve 10 is ensured by the flow of fuel back and forth between the upper armature chamber 39 and the lower armature chamber 40 via the peripheral fuel passage 41. The invention does not particularly specify the position of the peripheral fuel passage 41 and other fuel passages, however, and their locations can be freely selected anywhere apart from the flat section 36 of the flat armature 32.

In accordance with the present invention, since fuel passages, e.g. a peripheral fuel passage and/or an axial fuel passage, are formed apart from the flat section of the armature, it is possible to achieve various improvements in the performance of the solenoid fuel injection valve, such as that occurrence of noise during valve opening and bouncing during valve closing can be prevented, secondary injection can be reduced, wear of the seat portion can be decreased, operating noise can be lowered, and wear of the stop at the time of maximum needle valve lift can be reduced.

What is claimed is:

1. A solenoid fuel injection valve for an engine having at least one cylinder comprising:

a valve housing;

a solenoid winding provided in the valve housing;

an armature responsive to energizing of the solenoid winding, the armature having a coupling section and a flat section integral with the coupling section;

a fuel supply port;

a fuel passage coupled to the fuel supply port;

a valve seat formed with a nozzle communicable with the fuel supply port through the fuel passage;

a needle valve coupled to the coupling section of the armature, the needle valve enabling fuel to be injected from the nozzle into the cylinder of the engine when it is raised together with the armature in response to energizing of the solenoid winding;

an armature chamber accommodating the armature, wherein the flat portion of the armature partitions the armature chamber into an upper armature chamber and a lower armature chamber; and a portion of the fuel passage communicating the upper armature chamber and the lower armature chamber being provided at a location other than the flat section of the amature, the portion of the fuel passage being an axial fuel passage formed in the coupling section of the armature to face into the armature chamber.

2. A solenoid fuel injection valve according to claim 1, wherein fuel from the fuel supply port is supplied to an upstream side of the upper armature chamber.

3. A solenoid fuel injection valve according to claim 1, wherein:

the flat section of the armature is formed with a top pressure receiving surface on its side nearer the fuel supply port and with a bottom pressure receiving surface on its side nearer the nozzle; and the top pressure receiving surface faces the upper armature chamber and the bottom pressure receiving surface faces the lower armature chamber.

4. A solenoid fuel injection valve according to claim 1, wherein the armature chamber is utilized as a fuel reservoir at an intermediate portion of the fuel passage between the fuel supply port and the nozzle.

5. A solenoid fuel injection valve according to claim 6, further comprising a nozzle holder to which the valve seat is fixed, wherein the fuel supply port is formed by a fuel supply pipe and wherein the armature chamber is defined by the valve housing, the nozzle holder and the fuel supply pipe.

6. A solenoid fuel injection valve according to claim 1, wherein:

energizing of the solenoid winding causes fuel in the upper armature chamber to flow partially into the lower armature chamber to enable lifting of the needle valve; and de-energizing of the solenoid winding causes fuel in the lower armature chamber to flow partially into the upper armature chamber to apply pressure in the upper armature chamber on the flat section and suppress bouncing of the needle valve.

7. A solenoid fuel injection valve according to claim 1, wherein pressure in the upper armature chamber is greater than pressure in the lower armature chamber when the needle is seating on the seat portion of the valve seat.

8. A solenoid fuel injection valve according to claim 1, wherein the portion of the fuel passage communicating the upper armature chamber and the lower armature chamber is provided outward of the flat section.

9. A solenoid fuel injection valve according to claim 1, wherein the armature has pressure receiving surfaces and wherein the portion of the fuel passage communicating the upper armature chamber and the lower armature chamber is provided apart from the pressure receiving surfaces of the armature.

10. A solenoid fuel injection valve according to claim 1, further comprising a nozzle holder to which the valve seat is fixed, wherein the portion of the fuel passage communicating the upper armature chamber and the lower armature chamber is a peripheral fuel passage formed as a small gap between the nozzle holder and an outer peripheral surface of the flat section.

11. A solenoid fuel injection valve according to claim 10, wherein the flat portion of the armature has pressure receiving surfaces and wherein the peripheral fuel passage is formed at a peripheral portion of the pressure receiving surfaces of the flat section of the armature, at a location unrelated to the pressure receiving surfaces.

12. A solenoid fuel injection valve according to claim 10, wherein the flat section of the armature has a diameter of 16.6 mm, and the gap size is 0.1 mm–1.5 mm, preferably 0.2 mm–0.9 mm.

13. A solenoid fuel injection valve for an engine having at least one cylinder comprising:

a valve housing;

a solenoid winding provided in the valve housing;

an armature responsive to energizing of the solenoid winding, the armature having a coupling section and a flat section integral with the coupling section;

a fuel supply port;

a fuel passage coupled to the fuel supply port;

a valve seat formed with a nozzle communicable with the fuel supply port through the fuel passage;

a needle valve coupled to the coupling section of the armature, the needle valve enabling fuel to be injected from the nozzle into the cylinder of the engine when it is raised together with the armature in response to energizing of the solenoid winding;

an armature chamber accommodating the armature, wherein the flat portion of the armature partitions the armature chamber into an upper armature chamber and a lower armature chamber;

a portion of the fuel passage communicating the upper armature chamber and the lower armature chamber being provided at a location other than the flat section of the armature; and an axial fuel passage communicating the fuel supply port with the nozzle, the axial fuel passage being formed in the interior of the coupling section of the armature, and wherein the axial fuel passage faces into the armature chamber.

* * * * *